US007080459B1

(12) United States Patent
Khan

(10) Patent No.: US 7,080,459 B1
(45) Date of Patent: Jul. 25, 2006

(54) THREAD RULER AND A MULTI-FUNCTION DRAFTING INSTRUMENT

(76) Inventor: Ashfaq A. Khan, 5519 Cold Water Creek Ct., Baton Rouge, LA (US) 70808

( * ) Notice: Subject to any disclaimer, the term of this patent is extended or adjusted under 35 U.S.C. 154(b) by 0 days.

(21) Appl. No.: 10/906,931

(22) Filed: Mar. 14, 2005

(51) Int. Cl.
*B43L 11/045* (2006.01)
*B43L 9/04* (2006.01)

(52) U.S. Cl. ..... 33/27.03; 33/30.5

(58) Field of Classification Search ..... 33/27.03, 33/27.031, 27.032, 27.033, 30.1, 30.2, 30.3, 33/30.4, 30.5, 30.6, 30.7, 31, 484, 485, 810, 33/811, 812
See application file for complete search history.

(56) References Cited

U.S. PATENT DOCUMENTS 314,316 A * 3/1885 Christian ..... 33/561.2
1,148,122 A * 7/1915 Rees ..... 33/30.5
1,288,412 A * 12/1918 Hill ..... 33/27.03
1,488,641 A * 4/1924 Johnston ..... 33/30.5
2,542,561 A * 2/1951 Olejniczak ..... 33/27.031
2,654,952 A * 10/1953 Solon ..... 33/30.1
3,224,098 A * 12/1965 Terrell ..... 33/30.5
5,084,982 A * 2/1992 Feng ..... 33/810
6,167,628 B1 * 1/2001 Jones et al. ..... 33/27.03
2003/0154608 A1 * 8/2003 Khan ..... 33/27.03

* cited by examiner

*Primary Examiner*—R. Alexander Smith

(57) ABSTRACT

The Thread Ruler and Multi-Function Drafting Instrument is a single instrument designed to draw circles, ellipses and parallel lines, and which includes features that allow the instrument to function as protractor, a ruler and a drawing compass. The instrument has a slide ruler that holds a marking device and that has a stem with a thread attached. The thread is further attached to the main ruler body at an outer end of the protractor so that ellipses can be drawn. The instrument may be used on any flat marking surface including: paper, drafting table, chalkboard and dry erased board. The instrument may be adapted to be used in portable manner so that it can be placed in shirt pocket.

5 Claims, 4 Drawing Sheets

Figure 1.c
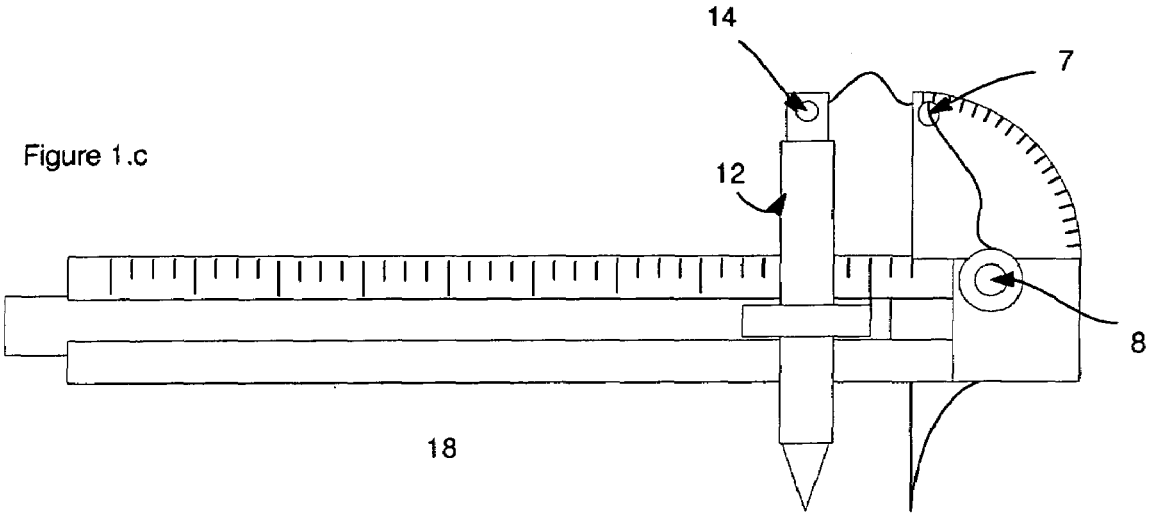
Figure 1.b
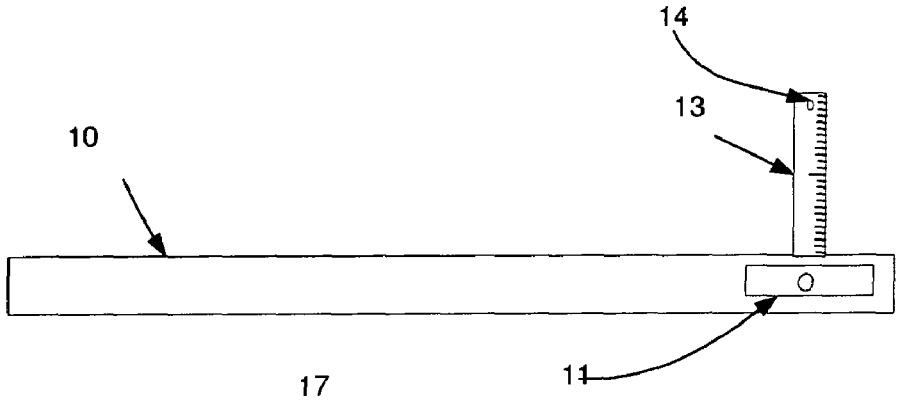
Figure 1.a
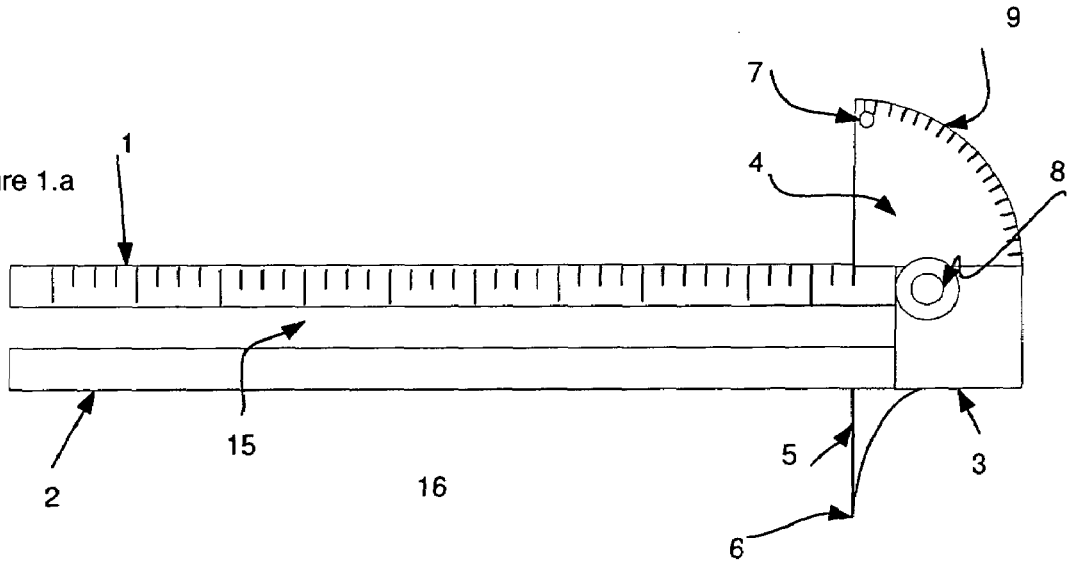

THREAD RULER AND A MULTI-FUNCTION DRAFTING INSTRUMENT

BACKGROUND OF THE INVENTION

This invention relates generally to drafting instruments and more specifically to multi-functional drafting instruments. The invention comprises of a two-piece drafting instrument with thread construction that may be used on a flat marking surface such as paper, dry erase board, chalk board and drafting table providing protractor, compass, and ruler functions plus the capability of drawing elliptical figures.

FIELD OF INVENTION

The drafting tools currently available that combine the protractor, compass and ruler functions do not provide capability of drawing ellipse. This is a unique tool for school children as they can learn to draw ellipses, parallel lines and circles using only one instrument that can also provide the functionality of compass and protractor. The instrument is safe and suitable for school children carrying it in their shirt pocket.

DESCRIPTION OF PRIOR ART

Limited combinations of various drafting tools are shown in the prior art. For example, U.S. Pat. No. 5,084,982 33/810 Discloses a drafting instrument that functions as vernier gauge and protractor. It uses a primary ruler with a protractor and a secondary ruler that is slide able inside the primary ruler providing the capability of vernier gauge and a protractor but the instrument lacks the capability of drawing ellipse or circles and also cannot hold the writing tool.

U.S. Pat. No. 5,497,558 33/27.03 Discloses a drafting instrument that functions as a protractor, compass, T-square and ruler. It uses a suction cup to hold on to the writing surfaces, which limits its use to only hard surfaces such as dry erase boards, chalkboards and tables. The instrument also cannot hold the writing tool and lacks the capability of drawing ellipse.

U.S. Pat. No. 3,378,927 33/26; discloses a drafting implement which can draw parallel lines on the blackboard and strike arcs about a center located near the edge of a blackboard. However, the device disclosed cannot draw ellipse. Further, the device of U.S. Pat. No. 3,378,927 is manufactured with at least ten different parts.

Similarly, U.S. Pat. No. 4,267,638 33/27.03 discloses an adjustable scaled compass, including a slotted body marked with multiple scales. This device also lacks a holding place for the writing tool. It cannot draw ellipse and does not have protractor function.

The U.S. Pat. No. 5,915,807 33/471 discloses an all-in-one drawing apparatus has a protractor integrated with horizontal and vertical rulers, but its use is limited to drawing board only and the instrument lacks the capability of drawing ellipse.

The U.S. Pat. No. 6,049,990 33/464 Discloses a Multi-function Layout Tool capable of performing the functions of an adjustable square, adjustable T-square, try square, combination square, protractor, angle duplicator, depth gauge, rip gauge, rafter-stair layout tool, and compass. The instrument cannot draw ellipse and its use of a fastener anchored to the base restricts its mobility.

The U.S. Pat. No. 2,542,561 Discloses a compass with spirit levels for guiding proper positioning of the instrument, which will permit drawing enlarged circles and arcs, but lacks the capability of drawing ellipse and parallel lines. The instrument cannot perform protractor function also.

The U.S. Pat. No. 1,670,509 Discloses a beam compass, which will permit drawing enlarged circles and arcs, but lacks the capability of drawing ellipse and parallel lines. The instrument cannot perform protractor function also.

Thus, there is a need for a simple, yet effective, inexpensive drafting Instrument that can function as a protractor, compass and ruler, besides providing the capability of drawing ellipse, parallel lines arcs and circle, all in one easy-to-use instrument.

BRIEF SUMMARY OF THE INVENTION

The present invention provides a two-piece drafting instrument for use on papers, drafting tables and dry erase chalkboards that provide the capability of drawing ellipses, besides combining the functionality of a compass, protractor and ruler. Two arm shaped plates joined at one end and guiding slots on the inside surface providing the main-ruler. A single plate with stem inserted into the guiding slot of the main-ruler providing the moveable slide-ruler. A quarter-circle plate extending through one arm of the main-ruler includes measurement indicia, indicating angles for use as a protractor. A pointed extension extruded from the other arm of the main-ruler providing an axis point during compass function. The main periphery of the quarter circle plate includes a pinhole and a mounting for thread spooler in the center. The slide-ruler stem also includes a pinhole at the end and a place ring with thumbscrew for holding a writing tool such as pencil, pen, chalk or marker.

Thread from the thread spooler is passed through the quarter circle pinhole and tied to the pinhole of the moveable slide-ruler stem. The length of the thread indicating the two radii of the ellipse can be measured by extending the slide-ruler. The pinhole of the slide-ruler stem and the pinhole of the main-ruler quarter-circle plate form the two foci of the ellipse.

To Use the Instrument as a Tool to Draw Ellipse

Extend the thread equal to the two radii of the ellipse and align the two pinholes with the desired foci, hook pencil or marker to the thread and move it in such a way that the thread stays taut while marks are drawn on the sheet, this will create one-half of the ellipse. To complete the ellipse, turn around the sheet to interchange the foci and repeat the step.

To Use the Instrument in Drawing Parallel Lines

Parallel lines can be drawn against the straight edge of the quarter circle and the edge of slider-ruler stem.

To Use the Instrument as a Compass

Position the pointed edge on the center of the desired circle, place a pencil or marker in the place ring of the slide-ruler and extend the slider out to the desired radius, place mark on the sheet while moving around the instrument using the pointed edge as the pivot point.

It is therefore an object of the present invention to provide a drafting instrument that can draw ellipse using thread construction besides combining the functions of a compass, protractor and ruler in a two-piece instrument that is easy to use and inexpensive to manufacture.

BRIEF DESCRIPTION OF THE DRAWINGS

This invention is illustrated more or less diagrammatically in the accompanying drawing, wherein:

FIG. 1.*a* is a front plan view of the main-ruler body.

FIG. 1.*b* is a front plan view of the slide-ruler body.

FIG. 1.*c* is a front plan view of the complete instrument with the thread construction.

DETAILED DESCRIPTION OF THE INVENTION

Figure 2:
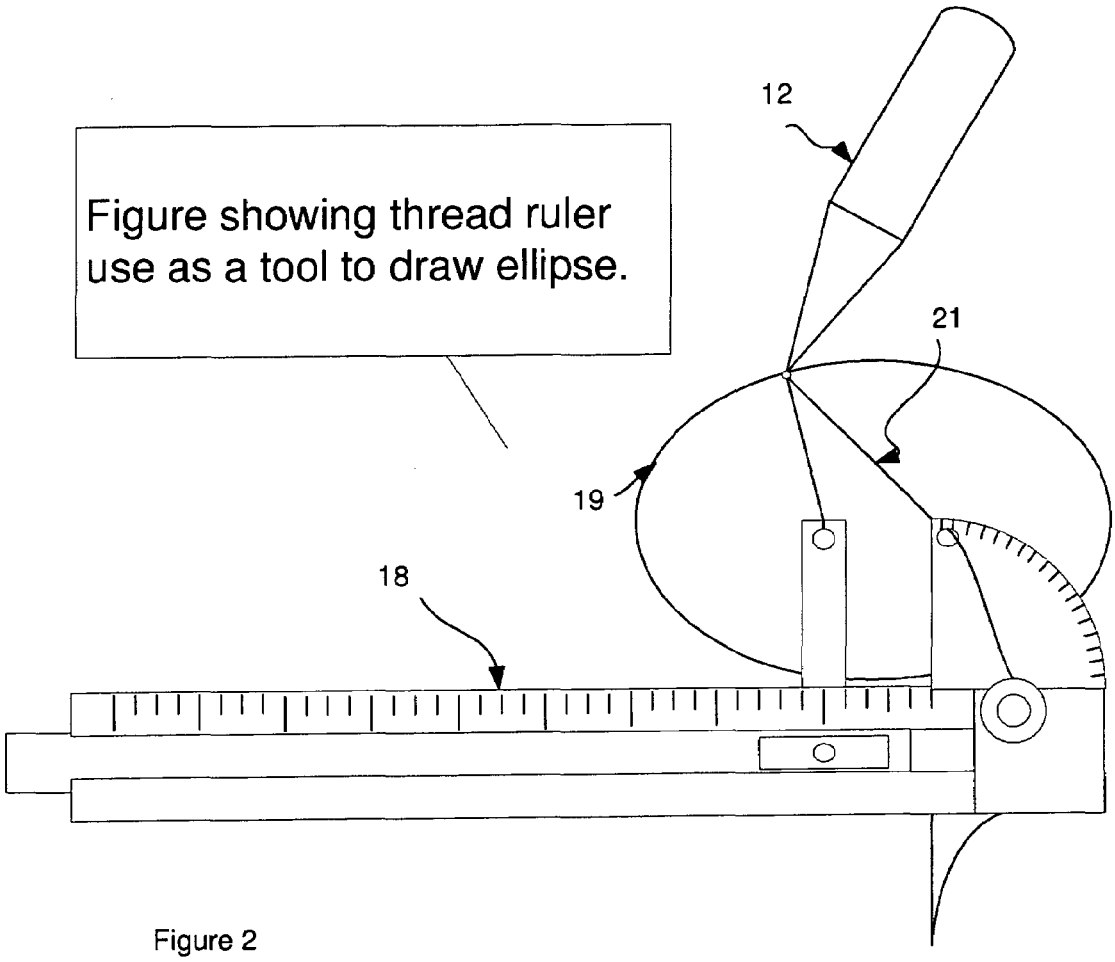
FIG. 2 is showing the use of the instrument as a tool to draw ellipse.

Thread Ruler is a unique instrument that is capable of drawing ellipse using thread construction. Besides drawing ellipse, the present invention dramatically improves the use of a single instrument that combines the functionality of compass, protractor and ruler. The instrument may be used on any flat marking surface including; paper, drafting table, chalkboard and dry erase board. The instrument may be adapted to be used in a portable manner so that it can be placed in a shirt pocket. Finally, the entire prior art directed to multi-functional drafting instruments lacks the capability of drawing ellipse and also, requires numerous parts and therefore must sell at a substantially higher cost than the device described by the present invention which may be manufactured from as little as three molded pieces namely, main-ruler, slide-ruler and thread spooler.

FIG. 1.*a* shows the drafting instrument main ruler body 16 includes two plate-shaped arms 1 and 2 joined on a side to the body 3. The body 3 having a quarter-circle plate 4 on one side adjacent to the arms 1 and 2 and an extrusion 5 with a pointed end 6 on the opposite side adjacent to the arms 1 and 2. The body 3 includes a pinhole 7 on the quarter-circle plate 4 and a thread spooler 8. The arms 1 and 2 extend outward and parallel from the side of the body 3 and define a slot 15 between and along the length of the said arms.

At least one of the arms 1 and 2 of the main ruler body 16 may have measurement indicia thereon. Said quarter-circle plate 4 having a peripheral edge that has a plurality of angle indicating indicia 9 which indicates angles when the quarter circle plate 4 is used as a protractor.

FIG. 1.*b* is the front view of the of the slide-ruler 17 having an elongated body 10 with the place ring 11 for holding pencil or marker 12, and a stem 13 which may have measurement indicia thereon and which is perpendicular to the longitudinal axis of the elongated body, said stem 13 having a pinhole 14 at the top of end to which one end of the thread is tied.

FIG. 1.*c* is the front view of the complet instrument 18 showing thread routing. Thread from the spooler 8 is routed through the quarter-circle plate pinhole 7 and tied to the slide-ruler stem pinhole 14.

FIG. 2 is the front view of the instrument 18 showing how to draw ellipse 19 with the help of the marker 12 hooked to the thread 21.

Figure 3:
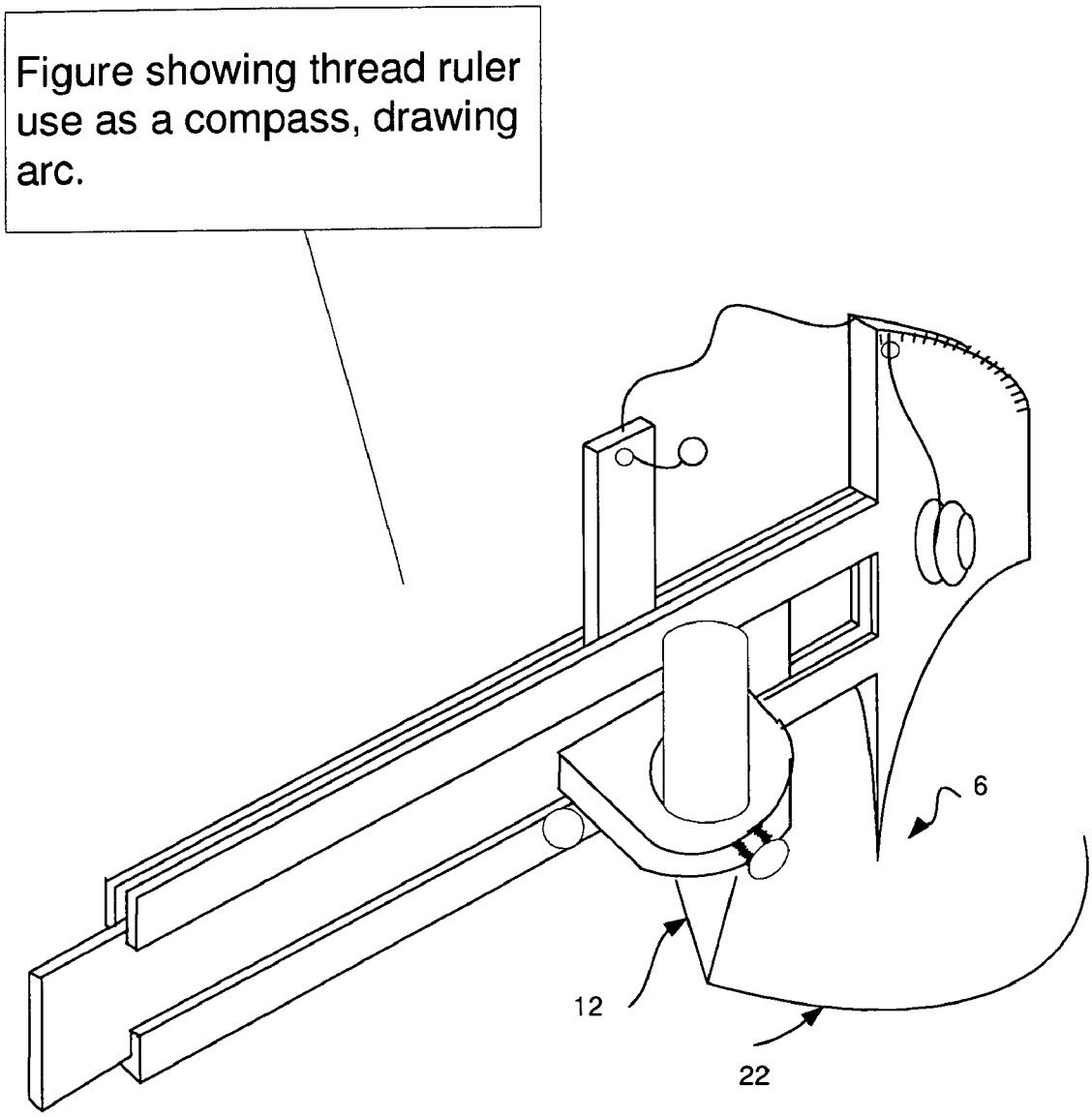
FIG. 3 is showing the use of the instrument as a tool to draw arcs.

FIG. 3 is the perspective of the instrument 18 showing how to draw arc 22 with help of the marker 12 by pivoting the instrument on the pointed edge 6.

Figure 4:
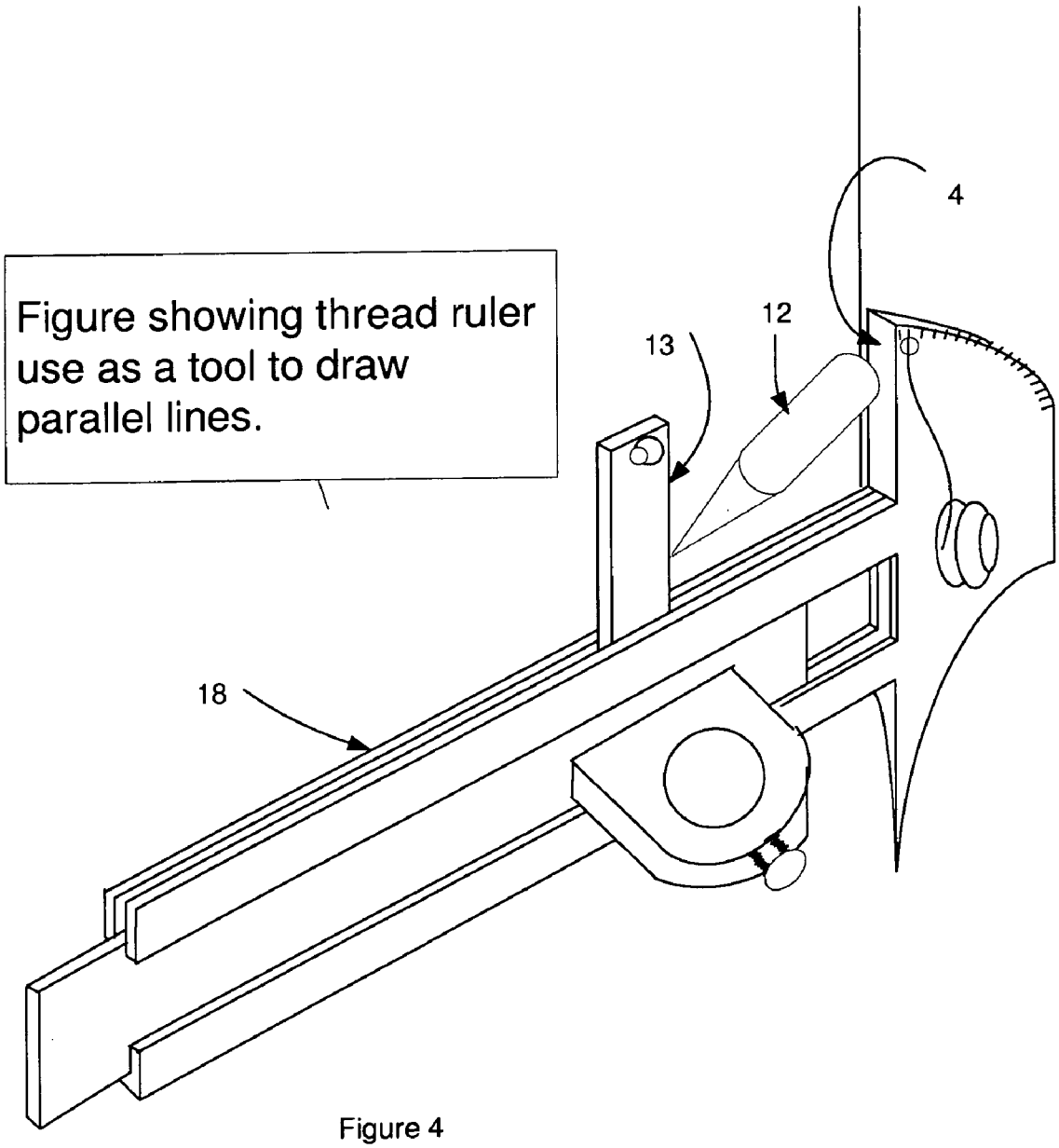
FIG. 4 is showing the use of the instrument as a tool to draw parallel lines.

FIG. 4 is the perspective of the instrument 18 showing how to draw parallel lines with the help of the marker 12 against the edges of the quarter circle plate 4 and the stem 13.

Thus, the present invention provides one instrument capable of drawing ellipse using thread construction and functioning as a compass, protractor, and ruler. The instrument is especially adaptable for holding a writing tool secured in the place ring 11. The instrument does not need to be attached to the flat surface while drawing arcs and circles as the pointed end 6 provides the means rotating around an an axis during compass function. A minitature model can be designed for the purpose of carrying in a shirt pocket. School children can easily adapt to its use, as it is simple and inexpensive compare to prior art.

It should be understood that this invention includes all modifications, which fall within the scope of the claims.

What is claimed is:

1. A drafting instrument comprising:

a main ruler body, said main ruler body having two plate shaped elongated arms joined on one side and extending outward and parallel on the other side, said arms defining a slot between and along the length of the said arms, one of said arms having an extrusion with a pointed end extending from said one arm, the other said arm having a quarter circle plate extending oppositely from said extrusion, said quarter circle plate having measurement indicia along a periphery indicating angles from 0 to 90 degrees to provide protractor function;

a slide ruler dimensioned to fit inside the slot and to slide freely along the two arms, said slide ruler having a place ring with an aperture that defines a means holding a writing tool, said aperture and said means being aligned with said extrusion having said pointed end to provide compass functions as the instrument is rotated about the pointed end, said slide ruler further including a stem extending outwardly opposite from said extrusion of said main ruler body and in alignment with said quarter circle plate of said main ruler body;

the stem having a pin hole at the top end and the quarter circle plate having a pin hole at an outward end wherein a thread is inserted through said pin hole of said quarter circle plate and tied to said pin hole of said stem, and wherein said pin holes form foci for an ellipse and said thread is a means for drawing said ellipse.

2. The drafting instrument of claim 1 further comprising said stem having an edge and said quarter circle having an edge wherein said edges are parallel to each other and from a means for drawing parallel lines.

3. The drafting instrument of claim 1 further comprising said stem having a straight edge with measurement indicia.

4. The drafting instrument of claim 1 further comprising at least one of said arms having a straight edge with measurement indicia.

5. The drafting instrument of claim 1 wherein said one side of said main ruler body further includes a thread spooler for holding a portion of said thread.

* * * * *